US005655489A

United States Patent [19]

Kammerer et al.

[11] Patent Number: 5,655,489

[45] Date of Patent: Aug. 12, 1997

[54] VALVE COVER

[75] Inventors: Roderich Kammerer, Bad Honnef; Frank Krause, Bergisch Gladbach, both of Germany

[73] Assignee: Bayer Aktiengesellschaft

[21] Appl. No.: 528,777

[22] Filed: Sep. 15, 1995

[30] Foreign Application Priority Data

Sep. 27, 1994 [DE] Germany ..... 44 34 453.8

[51] Int. Cl.[6] ..... F02F 7/00; F02F 11/00

[52] U.S. Cl. ..... 123/90.38; 123/195 C; 123/198 E

[58] Field of Search ..... 123/90.38, 195 C, 123/198 E

[56] References Cited

U.S. PATENT DOCUMENTS

| | | | |
|---|---|---|---|
| 4,027,644 | 6/1977 | Timour | 123/90.38 |
| 4,456,268 | 6/1984 | Penn et al. | 277/106 |
| 4,571,133 | 2/1986 | Lindow | 411/11 |
| 4,593,659 | 6/1986 | Wells et al. | 123/90.38 |
| 5,323,740 | 6/1994 | Daily et al. | 123/90.38 |
| 5,365,901 | 11/1994 | Kiczek | 123/90.38 |
| 5,375,569 | 12/1994 | Santella | 123/90.38 |

FOREIGN PATENT DOCUMENTS

| | | |
|---|---|---|
| 0 070 500 | 1/1983 | European Pat. Off. . |
| 42 21 760 | 6/1993 | Germany . |
| 1 263 077 | 2/1972 | United Kingdom . |

*Primary Examiner*—Weilun Lo
*Attorney, Agent, or Firm*—Connolly & Hutz

[57] ABSTRACT

The invention relates to an acoustically uncoupled valve cover for internal combustion engines with a flexible plastic seal as seal material and connecting elements with disc springs which acoustically uncouple the valve cover from the engine housing.

6 Claims, 3 Drawing Sheets

VALVE COVER

Figure 1:
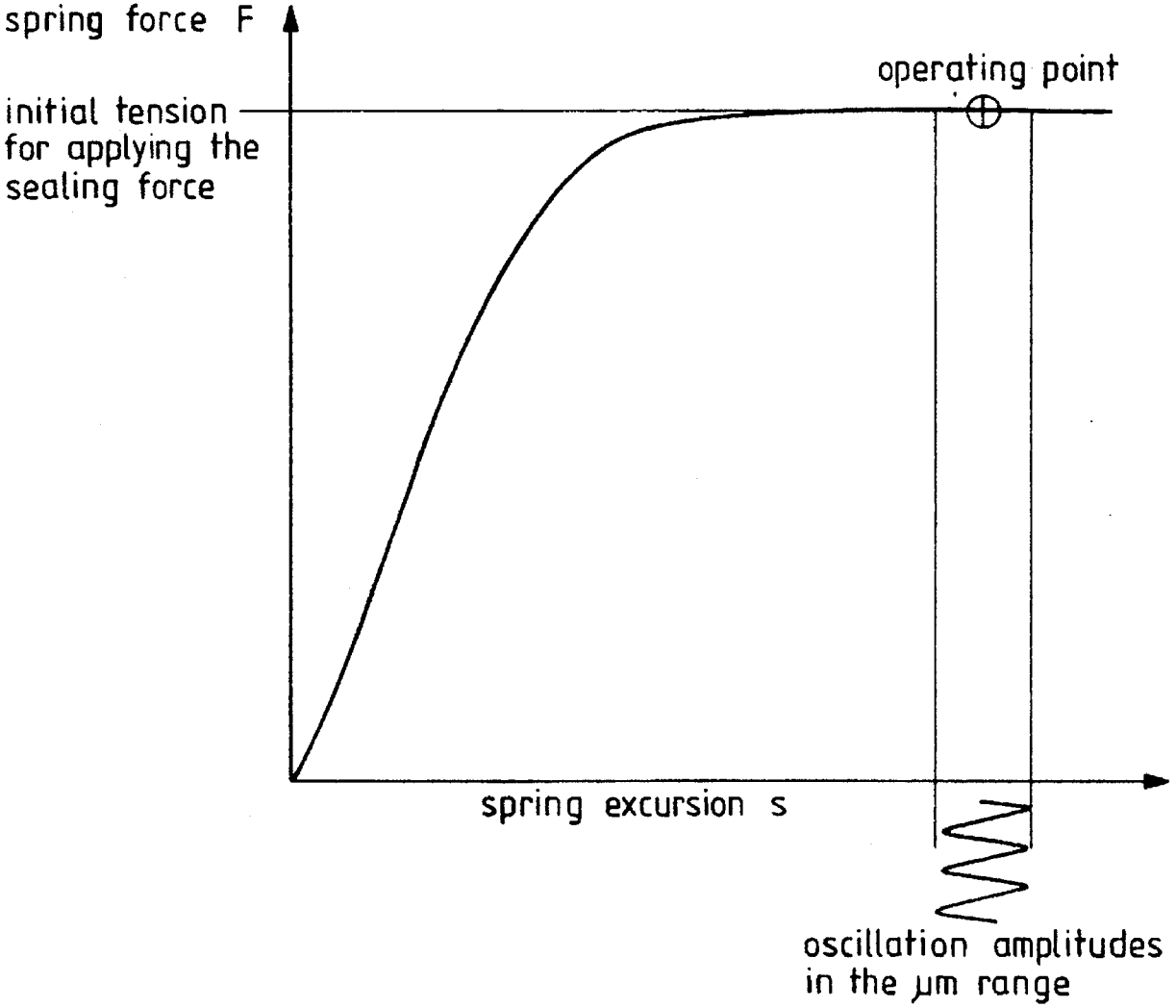

The invention relates to an acoustically uncoupled valve cover for internal combustion engines on the basis of plastic or metal as cover material with a flexible plastic seal as seal material and connecting elements with disc springs which acoustically uncouple the valve cover from the engine housing.

Valve covers cover the camshafts of internal combustion engines. The connection to the cylinder head is usually sealed off with a seal on the underside of the cover. This seal is pre-loaded by means of fixing screws on the cylinder head in order to apply the surface pressure required to seal the connection between valve cover and cylinder head.

The valve cover is traditionally made of aluminium. Occasionally, when the cover shape and the fixing concept so permit, plastic, such as polyamide, is also used. The use of plastic as cover material is advantageous compared with the use of metal, particularly aluminium, because manufacturing cost savings can be achieved and the cover is lighter in weight and has a better surface finish.

Recent, more stringent requirements in respect of reducing noise emission from internal combustion engines demand an acoustic uncoupling of the valve cover from the engine housing. This uncoupling concerns both sound transmission paths, namely the seal on the one, hand and the screw fixings of the valve cover on the other hand. In the case of the seal the uncoupling is achieved by means of correspondingly soft seal material, and in the case of the fixing of the cover, by means of so-called uncoupling elements under the fixing screws.

The use of plastic in particular as valve cover material has proved to be a disadvantage in valve cover designs known to date, for the following reasons:

The load represented by the initial tension occurs over a long period of time (i.e. over $10^3$–$10^4$ hours) in conjunction with high temperature variations (from –40° C. to 140° C.) or, in the case of a time-lapse test, within $10^3$ hours and a temperature of 130°–150° C. A high temperature and the long duration of the stress prove to be unfavourable for thermoplastics and the creep of the material is accelerated. In this case, creep is intended to mean a permanent change of shape with the consequence of a loss of initial tension until the valve cover begins to leak. In practice, therefore, it has been necessary to tighten the fixing screws at regular intervals by way of compensation, but there are several reasons why this cannot be done.

The said uncoupling elements are relatively expensive to manufacture. As they also have a soft intermediate layer made of an elastomer, they increase the risk of a loss of initial tension because of settling and creep effects. This explains why uncoupled plastic covers, for example, have not yet been used.

The object of the invention is to propose an acoustically uncoupled valve cover, particularly of plastic, preferably thermoplastic, as cover material which does not have the above.-mentioned disadvantages and in particular permits acoustic uncoupling while simultaneously maintaining the initial tension over as long a period as possible.

According to the invention this object is achieved by means of an acoustically uncoupled valve cover for internal combustion engines based on plastics material, particularly thermoplastic, or metal; particularly aluminium, magnesium, steel or titanium, particularly preferably of glass-fibre-reinforced polyamide-66, with a flexible plastic seal as seal material and one or more connecting elements, preferably screws, for connecting the valve cover to the engine housing, in which, to fix the valve cover to the engine housing, fixing elements are underlaid with disc springs which transmit the initial tension of the fixing elements to the valve cover, have a horizontal characteristic curve gradient in the force/spring excursion characteristic curve at the operating point (corresponding to a spring constant of 0) and in which the disc springs are guided in a seat of the valve cover.

In a preferred embodiment the fixing elements as well as the disc spring seat of the valve cover are provided with additional bearing surfaces for the disc springs.

By the use of the disc springs in the valve cover according to the invention, on the one hand an acoustic separation of the cover from the fixing screws is achieved because the spring constant of the disc springs at the operating point is approximately 0. Compensation of an initial tension loss is also achieved. The initial tension loss of the plastic cover because of material fatigue as a function of temperature and time only causes the operating point in the force/initial tension diagram of the disc springs (see FIG. 1) to deflect to the left without the initial tensioning force being reduced. This means that the sealing function of the valve cover remains unchanged. A further advantage of the use of disc springs according to the invention lies in the fact that, at a conservative estimate, the disc springs are less expensive to manufacture than customary uncoupling elements by one order of magnitude. Furthermore, they require less space.

Figure 2:
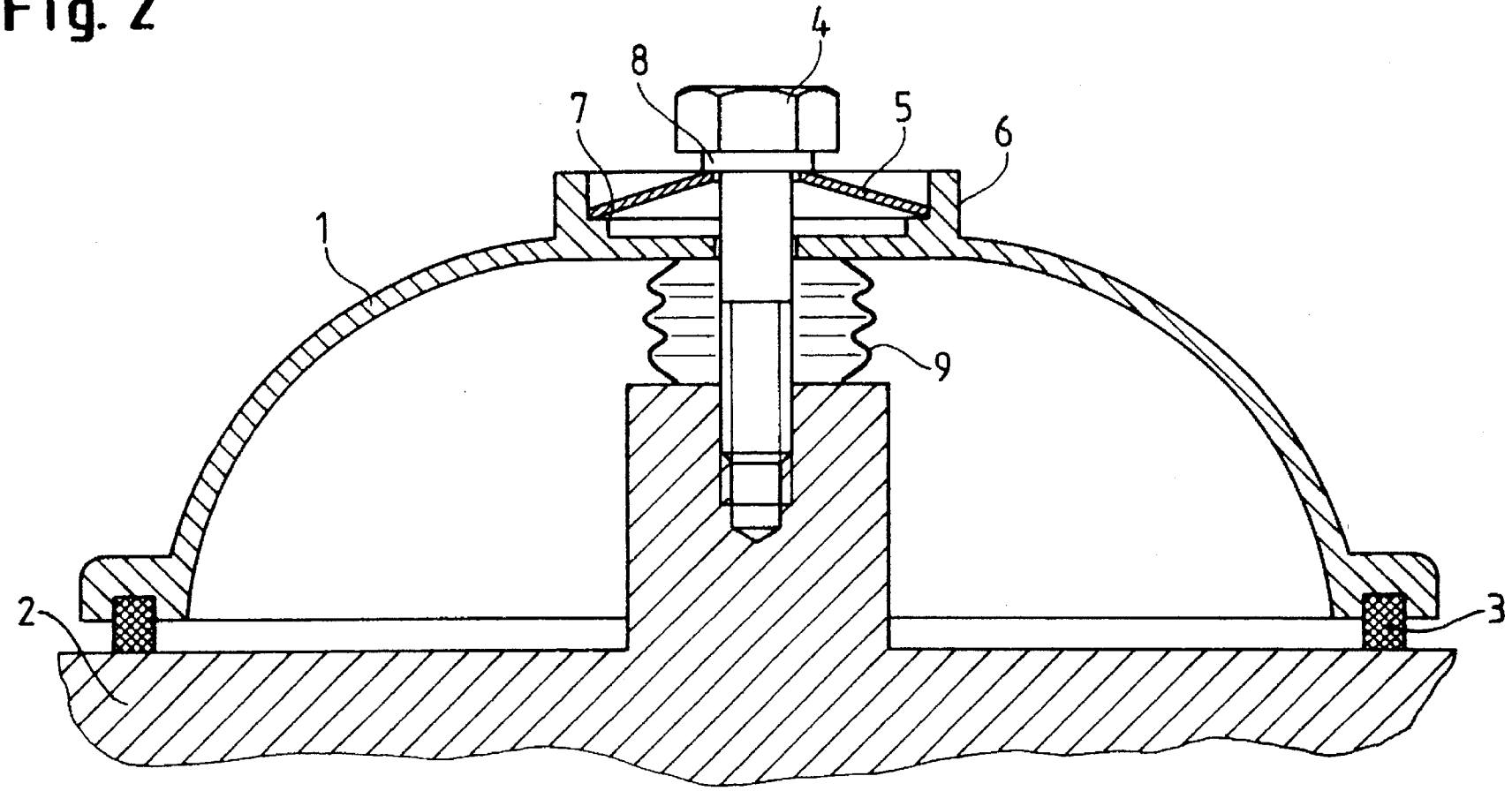
Figure 3:
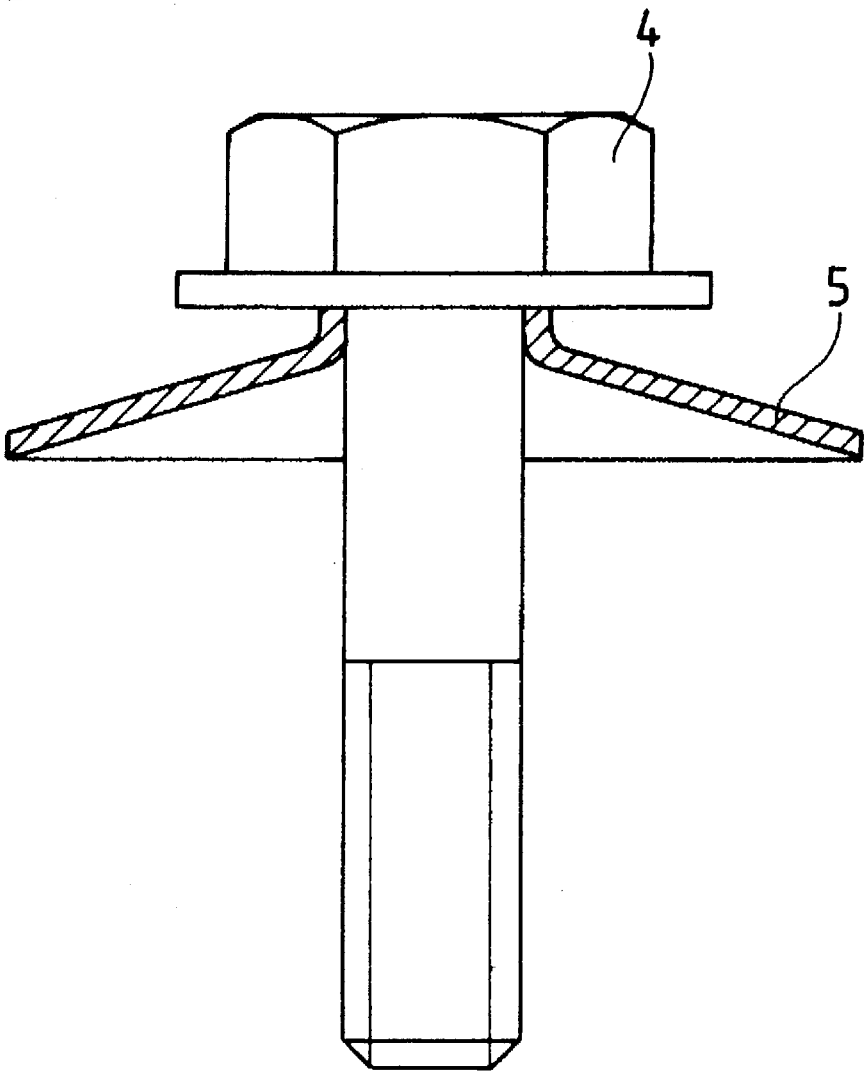

The invention will be described in greater detail below by way of example, with the aid of the drawings, in which:

FIG. 1 shows a diagrammatic spring force/initial tension graph of a disc spring, FIG. 2 shows a sectional drawing of the valve cover according to the invention, FIG. 3 shows a preferred disc spring form when standard screws are used.

The construction in FIG. 2 shows an example of a central screw connection. The valve cover 1 is connected to the engine housing 2 located beneath it by means of a fixing screw 4 with a disc spring 5 underneath it. The sealing of the valve cover 1 with the aid of the seal 3, can be achieved by using the customary temperature-resistant seal materials. In this case, silicone seals, such as Bayer's Silopren LSR 2030, in particular have proved to be advantageous acoustic uncoupling elements because of the low Shore hardness values that can be achieved.

In a variant shown in FIG. 2, the fixing screw 4 can have a small shoulder 8 at the top end of the screw shank in order to prevent a premature application of the disc spring on the underside of the screw head. Correspondingly a bearing surface 7 can also be provided in the disc spring seat 6 of the valve cover. Any additional sealing diaphragm 9 which may be used can prevent oil leakage in the region of the fixing elements.

If standard screws are used the internal diameter of the disc springs can also be configured according to the detail in FIG. 3.

Independently of the embodiment shown in FIG. 2, other methods of fixing valve covers, e.g. flange screw connections, can also be provided according to the invention. In the case of flange screw connection the cost advantage compared with known valve covers is increased because of the larger number of fixing elements required. A further effect of the central screw connection that is illustrated is that the temperature dependence of the initial tension, which is otherwise unavoidable because of the different coefficients of expansion between the plastic (of the valve cover) and the cast iron and/or aluminium (of the engine housing), is eliminated.

We claim:

1. An acoustically uncoupled valve cover for internal combustion engines on the basis of a plastic or a metal as a cover material with a flexible plastic seal as a seal material and one or more connecting elements to fix the valve cover to an engine housing, the fixing elements are underlaid with disc springs which transmit the initial tension of the fixing elements to the valve cover the disc springs have a horizontal characteristic curve gradient in the force/spring excursion characteristic curve at the operating point and in which the disc springs are guided in a seat of the valve cover.

2. A valve cover according to claim 1, characterized in that a thermoplastic or aluminum, magnesium, steel or titanium is used as the cover material.

3. A valve cover according to claim 1, characterized in that the cover material is glass-fibre-reinforced polyamide.

4. A valve cover according to claim 1, characterized in that screws which have an additional bearing surface are used as fixing elements.

5. A valve cover according to claim 1, characterized in that the seat of the valve cover has an additional bearing surface to guide the disc springs.

6. A valve cover according to claim 1, characterized in that silicone with low Shore hardness is used as the seal material for the valve cover seal.

* * * * *